United States Patent [19]

Speil

[11] Patent Number: 4,924,825

[45] Date of Patent: May 15, 1990

[54] OUTER GUIDE MEANS FOR A VALVE TAPPET

[75] Inventor: Walter Speil, Ingolstadt, Fed. Rep. of Germany

[73] Assignee: Motomak Motorenbau, Maschinen-und Werkzeugfabrik, Konstruktionen GmbH, Fed. Rep. of Germany

[21] Appl. No.: 324,409

[22] Filed: Mar. 15, 1989

Related U.S. Application Data

[63] Continuation of Ser. No. 703,881, Feb. 21, 1985, abandoned.

[30] Foreign Application Priority Data

Mar. 14, 1984 [DE] Fed. Rep. of Germany ..... 3409235

[51] Int. Cl.[5] ..... F01L 1/14

[52] U.S. Cl. ..... 123/90.55; 123/90.51

[58] Field of Search ..... 123/90.43, 90.46, 90.51, 123/90.55, 90.56, 90.57, 90.58, 90.59

[56] References Cited

U.S. PATENT DOCUMENTS 3,658,038 4/1972 Bergmann ..... 123/90.51 X 4,367,701 1/1983 Buente ..... 123/90.51 X 4,430,970 2/1984 Holtzberg et al. ..... 123/90.51

FOREIGN PATENT DOCUMENTS 2070181 9/1981 United Kingdom ..... 123/90.55

*Primary Examiner*—Stephen F. Husar

*Attorney, Agent, or Firm*—Bierman & Muserlian

[57] ABSTRACT

An outer guide means for a valve tappet receiving an automatic, hydraulic clearance compensation element of use in internal combustion engines, the tappet being disposed directly between a cam of a camshaft and a valve stem, the guide means comprising a wear-resistant end member co-operating with the cam, a hollow cylindrical stem part made of an extrudable polymeric substance and closed at one end by the end member and sliding in a guide bore in a cylinder head, and means coaxially disposed in the stem part thereof and adapted to receive the clearance compensation element, characterized in that a thin-walled unitary reinforcing element (10, 22, 41) is provided which is drawn from sheet metal and which, on the one hand, is secured to the end member (8, 26, 42) and, on the other hand, is positively connected to the stem part (9, 32, 36).

14 Claims, 3 Drawing Sheets

OUTER GUIDE MEANS FOR A VALVE TAPPET

PRIOR APPLICATION

This application is a continuation of copending U.S. patent application Ser. No. 703,881 filed Feb. 21, 1985, now abandoned.

STATE OF THE ART

Outer guide means for a valve tappet receiving an automatic, more particularly hydraulic, clearance compensation element of use in internal combustion engines, the tappet being disposed directly between a cam of a camshaft and a valve stem, the guide means comprising a wear-resistant end member cooperating with the cam, a hollow cylindrical stem part made of an extrudable polymeric substance and closed at one end by the end member and sliding in a guide bore in a cylinder head; and a means disposed coaxially in the stem part thereof and adapted to receive the clearance compensation element and made of light metal is disclosed in EP-OS No. 00 30 780. To ensure that the wearing and sliding properties of the guide means in the cylinder head guide bore meet practical requirements, the outer generated surface referred to is in the known guide means provided with a wear-resistant layer.

A layer of this kind, which requires extra labor and costs for its provision, can be obviated if the guide means is made of a polymeric substance since such substances nearly always have satisfactory wearing and sliding properties when used in co-operation with metal substance. However, it is not readily possible for the known guide means to be made of a polymeric substance instead of from a light metal. The first difficulty is that, unlike the known guide means, the end member cannot be secured to the stem part with adequate reliability by beading. The second difficulty is that in the known guide means all the force necessary to actuate the valve passes through a base-like part of the stem part, the base-like part being engaged by the clearance compensation element, but reasons of strength preclude the use of this system with a polymeric substance.

OBJECTS OF THE INVENTION

It is an object of the invention to provide a polymeric guide means of the kind referred to wherein the end member is secured reliably to the stem part and there is no overstressing of the polymeric substance.

This and other objects and advantages of the invention will become obvious from the following detailed description.

THE INVENTION

The outer guide means of the invention for a valve tappet receiving an automatic, hydraulic clearance compensation element of use in internal combustion engines, the tappet being disposed directly between a cam of a camshaft and a valve stem, the guide means comprising a wear-resistant end member co-operating with the cam, a hollow cylindrical stem part made of an extrudable polymeric substance and closed at one end by the end member and sliding in a guide bore in a cylinder head, and means coaxially disposed in the stem part thereof and adapted to receive the clearance compensation element is characterized in that a thin-walled unitary reinforcing element (10, 22, 41) is provided which is drawn from sheet metal and which, on one hand, is secured to the end member (8, 26, 42) and, on the other hand, is positively connected to the stem part (9, 32, 36). The thin-walled unitary reinforcing element is preferably positively connected by extrusion sheathing to the stem part.

This features provides the foundation for reliable securing of the end member to the stem part and, because of the construction of the invention of the outer guide means, the clearance compensation element can directly engage with that side of the end member which is distal from the cam. In a variation of the invention, the reinforcing element has a tubular portion connected by its outer generated surface to the stem part and by one of its ends to the end member.

As an aid in assembly of the guide means and to reduce the load on the connection between the end member and the reinforcing element caused by forces operative transversely of the tappet longitudinal axis between the end member and the cam as a result of friction, the reinforcing element has provision for centering the end member. In this event, according to another feature of the invention, the centering provision takes the form of a tubular terminal section of the reinforcing element and the end member is disposed in the bore of the terminal section.

According to the invention, the reinforcing element has a bearing surface for that side of the end member which is remote from the cam to reduce the action on the connection between the end member and the reinforcing element of forces which in operation act lengthwise of the tappet. In this event, this bearing surface can be a radially extending annular flange which connects the tubular portion to the terminal section, the outer diameter thereof being greater than that of the tubular portion by an amount to be equal to or less than the outer diameter of the stem part, or the bearing surface can be an inwardly directed fold at the transition between the tubular portion and the terminal section.

According to other features of the invention, the end member is connected to the reinforcing element by a homogenous joint, more particularly by soldering or welding, or the end member is secured positively to the reinforcing element and sealing means are provided between the end member and the reinforcing element.

In a variation of the invention, as a very simple yet strong way of securing the clearance compensation element in the guide means, the means receiving the clearance compensation element is formed on the reinforcing element.

According to other features of the invention, the means for receiving the clearance compensation element take the form of an inwardly directed flange formed on that end of the tubular portion which is distal from the end member, the flange merging in its bore into a hollow cylindrical element or the flange is conical, its taper and the hollow cylindrical extending towards the end member.

In a final feature of the invention, the portion of the reinforcing element by which it is connected to the stem part is formed so that the reinforcing element is secured against rotation and axial displacement relative to the stem part.

Referring now to the drawings.

Figure 1:
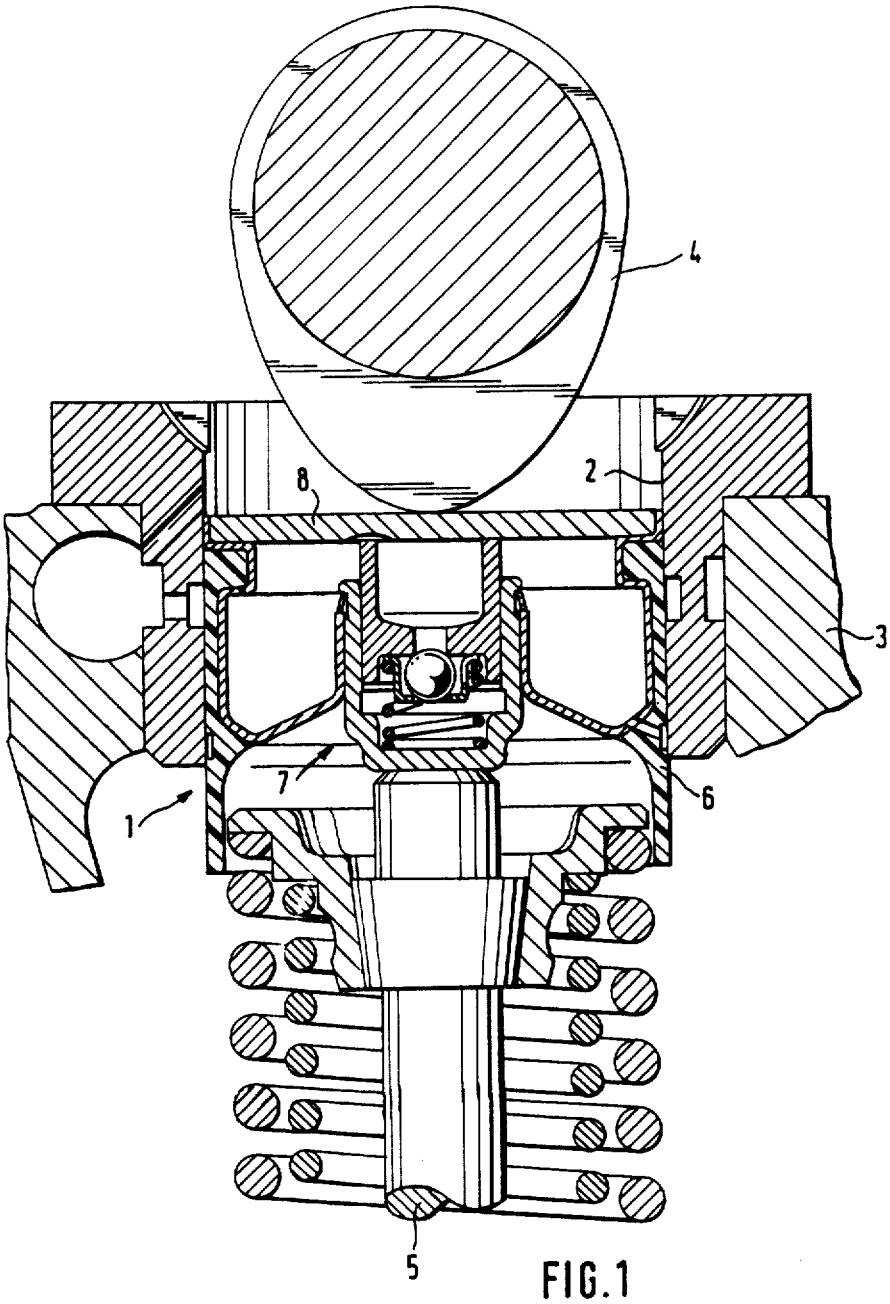
FIG. 1 is a longitudinal cross-section in the cylinder head of an internal combustion engine of a tappet having an outer guide means of the invention in the assembled state.

Referring to FIG. 1, a valve tappet 1 is mounted for longitudinal movement in a guide bore 2 in a cylinder head 3 and is disposed directly between a cam 4 and a valve stem 5. The tappet 1 comprises an outer guide means 6 and coaxially disposed therein is a hydraulic clearance compensation element 7, the means 6 having an end member 8 which co-operates with the cam 4, the clearance compensation element 7 engaging directly that side of the end member which is distal from the cam 4.

Figure 2:
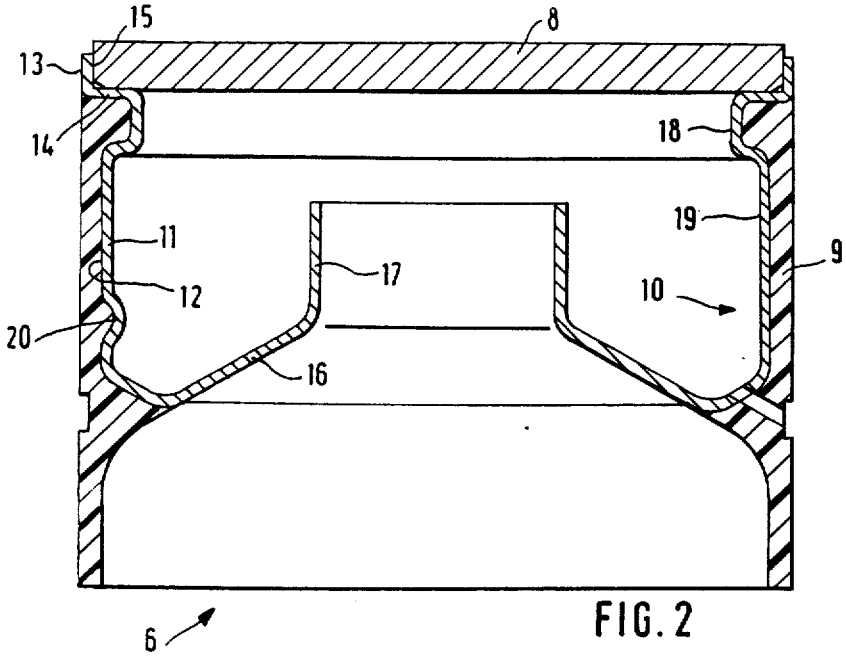
FIG. 2 to 4 are longitudinal cross-sectional view of different embodiments of outer guide means of the invention.

As FIG. 2 shows, the outer guide means 6 also comprises a stem part 9 and a thin-walled unitary reinforcing element 10, the part 9 being closed at one end by the end member 8. The element 10 has a tubular portion 11 positively connected by its outer generated surface 12 to the stem part 9. Tubular portion 11 of reinforcing element 10 merges into a tubular terminal section 13 whose outer diameter is greater than that of the tubular portion 11 by an amount corresponding to the outer diameter of stem part 9. Section 13 is connected to portion 11 by an annular flange 14 on which the end member 8 bears, the same being centered in bore 15 in section 13 and being secured in fluid-tight manner by peripheral welding.

Tubular portion 11 merges, at the end distal from the end member 8, into an inwardly directed conical flange 16 which merges in its bore into a hollow cylindrical portion 17 adapted to receive clearance compensation element 7, the taper of conical flange 16 and part 17 extending towards end member 8. To provide a positive connection between stem part 9 and tubular portion 11, portion 11 is drawn in at one end, after annular flange 14, to a diameter 18 less than the diameter of the adjacent zone 19 and is formed at the other end with an inwardly directed bulge-like recess 20. These features provide securing against axial movement and against rotation between part 9 and element 10.

Figure 3:
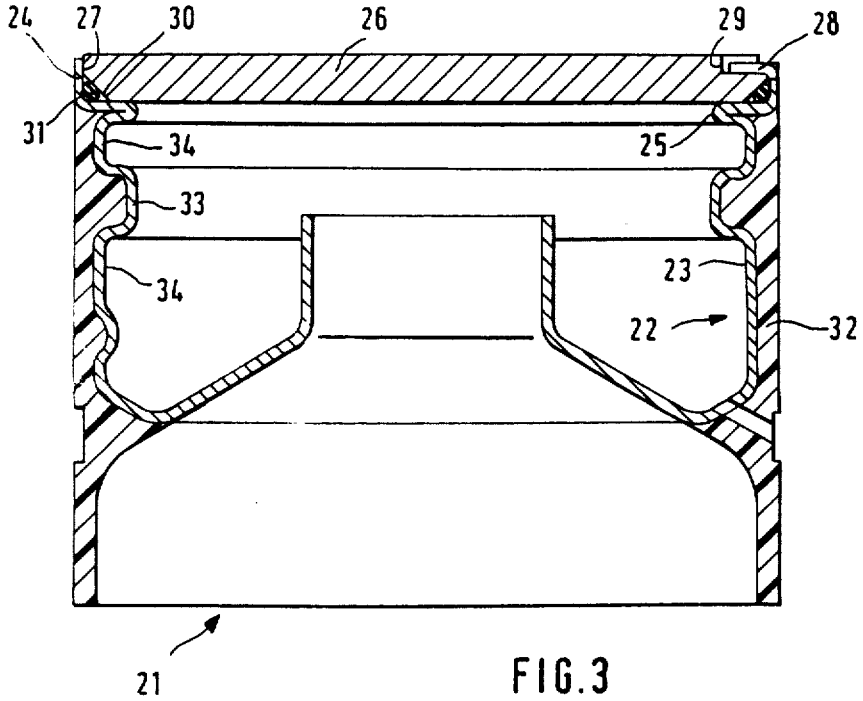

FIG. 3 shows an outer guide means 21 differing from the guide means of FIG. 2, in that reinforcing element 22 has at the transition between its tubular portion 23 and its terminal section 24 a peripheral inwardly directed fold 25 on which the end member 26 bears. To secure end member 26 in bore 27 of section 24, lugs or the like 28 are distributed over the periphery of the free end of section 24 and are bent round into corresponding recesses 29 in end member 26. The same has on its underside a bevel 30 engaged by an O-ring 31 disposed between element 22 and end member 26. O-ring 31 ensures a fluid-tight connection with reinforcing element 22 even when the end member is retained positively. In the case of the outer guide means 21 of FIG. 3, a positive connection between stem part 32 and tubular portion 23 of reinforcing element 22, to prevent axial movement between these two parts, is achieved in that tubular portion 23 is drawn in at one place to a diameter 33 smaller than the diameter of adjacent zones 34.

Figure 4:
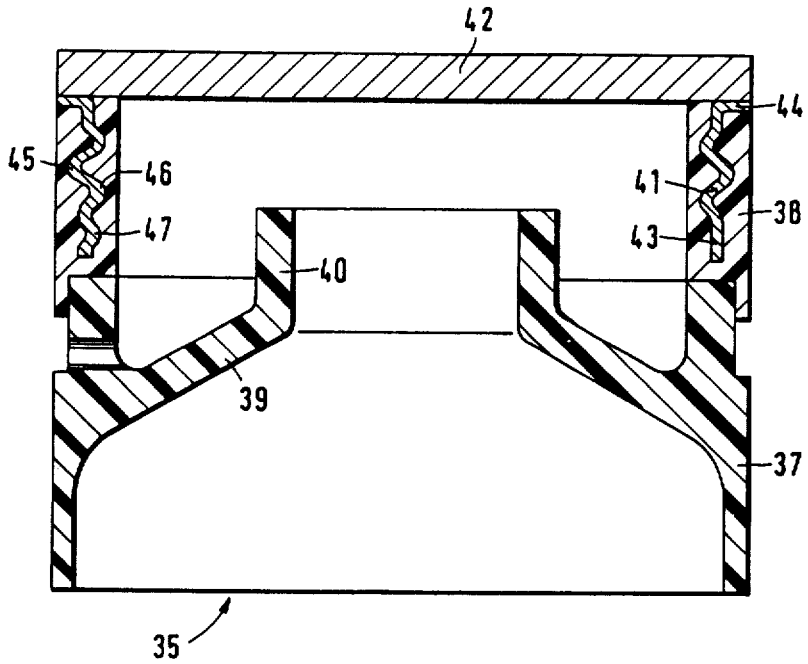

FIG. 4 shows an outer guide means 35 that differs from the ones described above in that its stem part 36 comprises two separately manufactured parts 37 and 38 which are connected by a homogenous joint, provided for instance by ultrasonic-welding. While part 37 is provided with an inwardly directed conical flange 39 which merges in its bore in a hollow cylindrical part 40 adapted to receive the clearance compensation element, part 38 is connected positively to a thin-walled reinforcing element 41 which is secured in fluid-tight manner to end member 42 by welding. The reinforcing element 41 comprises a tubular portion 43 and a radially outwardly directed flange 44 on which end member 42 bears. In the axial direction, the positive connection between reinforcing element 41 and stem part 36 is provided by tubular portion 43 of reinforcing element 41 having regions 45 of greater diameter and regions 46 of smaller diameter. To prevent reinforcing element 41 from rotating relative to stem part 36, reinforcing element 41 is formed with an inwardly directed bulge 47. The said construction of outer guide part 35 allows end member 42 to be generally of the same outer diameter as stem part 36. In addition, conical flange 39 as well as hollow cylindrical part 40 receiving the clearance compensation element consist of polymeric material, the mass of outer guide part 35 being further reduced by this feature.

Various modifications of the outer guide means of the invention may be made without departing from the spirit or scope thereof and it is to be understood that the invention is intended to be limited only as defined in the appended claims.

What I claim is:

1. An outer guide means for a valve tappet receiving an automatic, hydraulic clearance compensation element for use in internal combustion engines, the tappet being disposed directly between a cam of a camshaft and a valve stem, the guide means comprising a wear-resistant, metallic end member co-operating with the cam, a hollow cylindrical stem part made of an extrudable polymeric substance and closed at one end by the end member and sliding in a guide bore in a cylinder head, and means coaxially disposed in the stem part thereof and adapted to receive the clearance compensation element, characterized in that a thin-walled unitary reinforcing element is provided which is drawn from sheet metal and which, on the one hand, is secured to the end member and, on the other hand, is positively connected to the stempart by being embedded in the polymeric substance, and that the hydraulic clearance compensation element with its end remote from the valve stem directly bears against the end member.

2. The guide means of claim 1 wherein the positive connection of the reinforcing element to the stem part is provided by extrusion sheathing.

3. A guide means of claim 1 wherein the reinforcing element has a tubular portion connected by its outer generated surface to the stem part and by one of its ends to the end member.

4. A guide means of claim 1 wherein the reinforcing element has provision for centering the end member.

5. A guide means of claim 4 wherein the centering provision is in the form of a tubular terminal section of the reinforcing element and the end member is disposed in the bore of the terminal section.

6. A guide means of claim 1 wherein the reinforcing element has a bearing surface for the side of the end member which is remote from the cam.

7. A guide means of claim 6 wherein the bearing surface is a radially extending annular flange connecting the tubular portion to the terminal section, the outer diameter thereof being greater than that of the tubular portion by an amount to be equal to or less than the outer diameter of the stem part.

8. A guide means of claim 6 wherein the bearing surface is a circumferential inwardly directed fold at the transition between the tubular portion and the terminal section.

9. A guide means of claim 1 wherein the end member is connected to the reinforcing element by a homogenous joint.

10. A guide means of claim 1 wherein the end member is secured positively to the reinforcing element and sealing means are provided between the end member and the reinforcing element.

11. A guide means of claim 1 wherein the means receiving the clearance compensation element is integral with the reinforcing element.

12. A guide means of claim 3 wherein the means take the form of an inwardly directed flange formed on that end of the tubular portion distal from the end member, the flange merging in its bore into a hollow cylindrical element.

13. A guide means of claim 12 wherein the flange is conical, its taper and the hollow cylindrical element extending towards the end member.

14. A guide means of claim 1 wherein the portion of the reinforcing element connecting it to the stem part, is formed so that the reinforcing element is secured against rotation and axial displacement relative to the stem part.

* * * * *